US006148835A

United States Patent [19]

Rhee

[11] Patent Number: 6,148,835

[45] Date of Patent: Nov. 21, 2000

[54] TEMPORARY HOUSING FRAME

[76] Inventor: Seung Do Rhee, 303 Ilo 8-3 Eungam 1-Dong, Eunpoung-Ku, Seoul, Rep. of Korea

[21] Appl. No.: 09/098,583

[22] Filed: Jun. 17, 1998

[30] Foreign Application Priority Data

Jun. 18, 1997 [KR] Rep. of Korea ..... 97-25554

[51] Int. Cl.[7] ..... E04H 15/50

[52] U.S. Cl. ..... 135/145; 135/131; 135/139; 135/146; 135/158; 135/128; 52/109; 52/646

[58] Field of Search ..... 135/130, 131, 135/132, 139, 141, 143, 144, 145, 146, 157, 158, 122, 124, 128; 52/109, 646

[56] References Cited

U.S. PATENT DOCUMENTS

| | | | |
|---|---|---|---|
| 3,185,164 | 5/1965 | Pinero | 135/145 |
| 3,559,353 | 2/1971 | Partridge | 52/109 X |
| 4,156,433 | 5/1979 | Beaulieu | 52/109 X |
| 4,689,932 | 9/1987 | Zeigler | 52/109 X |
| 5,035,253 | 7/1991 | Bortles | 135/122 X |
| 5,125,205 | 6/1992 | Wichman | 52/109 X |
| 5,274,980 | 1/1994 | Zeigler | 135/139 X |
| 5,490,532 | 2/1996 | Mallookis et al. | 135/157 X |
| 5,634,483 | 6/1997 | Gwin | 135/157 X |
| 5,701,923 | 12/1997 | Losi, Jr. et al. | 135/145 X |
| 5,934,301 | 8/1999 | Carter | 135/145 |

*Primary Examiner*—Beth A. Stephan
*Assistant Examiner*—Brian E. Glessner
*Attorney, Agent, or Firm*—Anderson, Kill & Olick P.C.

[57] ABSTRACT

A temporary housing frame is provided including a plurality of supporting columns. A first link member formed from equal length rod member connects two adjacent supporting columns. A second link member connects between the other supporting columns and is composed of second rod members having respectively different lengths which are crossed and combined rotatably with each other so that at least one side has an ascending structure if the second link member is unfolded. A slider is provided for connecting both ends of the first and second link members to the supporting column as well as a slider fixing unit for stopping the slider from descending by its gravitational weight.

6 Claims, 12 Drawing Sheets

TEMPORARY HOUSING FRAME

BACKGROUND OF THE INVENTION

1. Field of the Invention

The present invention relates to a temporary housing frame for maintaining the shape of a tent or a shelter to screen rain, wind or sun light, and more particularly, to a temporary housing frame capable of forming a roof having a slope by an assembly of link members of a respectively different length.

2. Description of the Prior Art

In a general temporary housing frame such as a tent capable of being assembled or disassembled, a link structure is sequentially and repeatedly formed between two adjacent supporting columns among four supporting columns each located at four corners in which rod members each having the same length are crossed at its center and connected to each supporting column. Also, a separate central supporting member for forming a ceiling portion is installed in the inner center of the space formed by the four supporting columns. Such a conventional temporary housing frame will be described in more detail with reference to FIGS. 1 and 2.

FIG. 1 is a perspective view showing a conventional temporary housing frame and FIG. 2 is a cross-sectional view showing a leg and a slider fixing unit in the conventional temporary housing frame.

As shown in FIGS. 1 and 2, the conventional temporary housing frame is comprised of at least two supporting columns 10 formed of a multi-stage rod member the length of which can telescopically increase or decrease by being pushed into or pulled out by a user, in which each supporting column includes a leg fixing unit 11 for stopping the rod member from being drawn out by the pulling and from being restored to the original position by its gravitational weight. The conventional temporary housing frame also includes a link member 20 which is sequentially and repeatedly connected between the two adjacent supporting columns 10 and can be folded with or unfolded from each other, in which rod members 20A and 20B each having the same length are crossed at its center and connected to each supporting column 10, and a slider 31 which can slide up and down along each supporting column 10 in order to fix both ends of the link member 20 to the corresponding supporting column 10. The upper portions of the slider 31 and the supporting column 10 are formed to be congruent with holes formed in the end portions of the rod members 20A and 20B of the link member 20 so that a pin connection is possible. Also, a slider fixing unit 12 is provided on the supporting column 10 for stopping the slider 31 from being again descendent by its gravitational weight. As shown in FIG. 2, an elastic protrusion of a hemispherical shape which is drawn into the supporting column 10 by the depression of the user and protruded by its own elasticity is provided in the slider fixing unit 12 and the leg fixing unit 11, and a stopper hole 13 is formed on the slider 31 and the supporting column 10 respectively in order to be fitted into or from the elastic protrusion. Also, a separate central supporting member 40 formed of a rod member of a certain length is provided between the adjacent supporting columns 10 or in the central portion of the space made by all the supporting columns 10 in order to form a ceiling portion of the tent and is combined with a subordinate member 40A.

Thus, the conventional temporary housing frame as described above has only a function of simply folding and unfolding the link member in which two rod members of the same length are crossed to each other. As a result, the conventional temporary housing frame necessarily requires a separate central supporting member and a subordinate member to form a ceiling portion, which causes increase of production cost as well as the working hours in fabrication and assembly. Since only the central portion in the conventional temporary housing frame is supported to form a ceiling portion, it is difficult to firmly and persistently maintain the shape of the temporary housing frame, to thereby cause use efficiency of the space to lower in view of the utility of the space.

SUMMARY OF THE INVENTION

To solve the above problems, it is an object of the present invention to provide a temporary housing frame of which the spatial use efficiency is excellent and which can form a slope roof having a firm ceiling portion without having a separate central supporting member and a subordinate member.

To accomplish the above object of the present invention, there is provided a temporary housing frame comprising: a plurality of supporting columns each having a certain length; a first link member which connects two adjacent supporting columns and can be folded and unfolded; a second link member which connects between the other supporting columns which are not connected by the first link member and to at least one end of which rod members having a respectively different length are crossed and combined rotatably with each other, in such a manner that at least one side has an ascending structure if the second link member is unfolded; and a fixing portion which includes a slider which is slided up and down on each supporting column, for connecting both ends of the first and second link members to the supporting column, a slider fixing unit provided on each supporting column for stopping the slider from being descendent by its gravitational weight, and a fixing piece is attached to the said slider and supporting column to connect the first and second link members on one side of the supporting column.

BRIEF DESCRIPTION OF THE DRAWINGS

The above object and advantages of the present invention will be apparent by describing the structure and operation thereof in detail with reference to the attached drawings in which.

DETAILED DESCRIPTION OF THE INVENTION

Preferred embodiment of the present invention will be described in detail with reference to the accompanying drawings.

Figure 3:
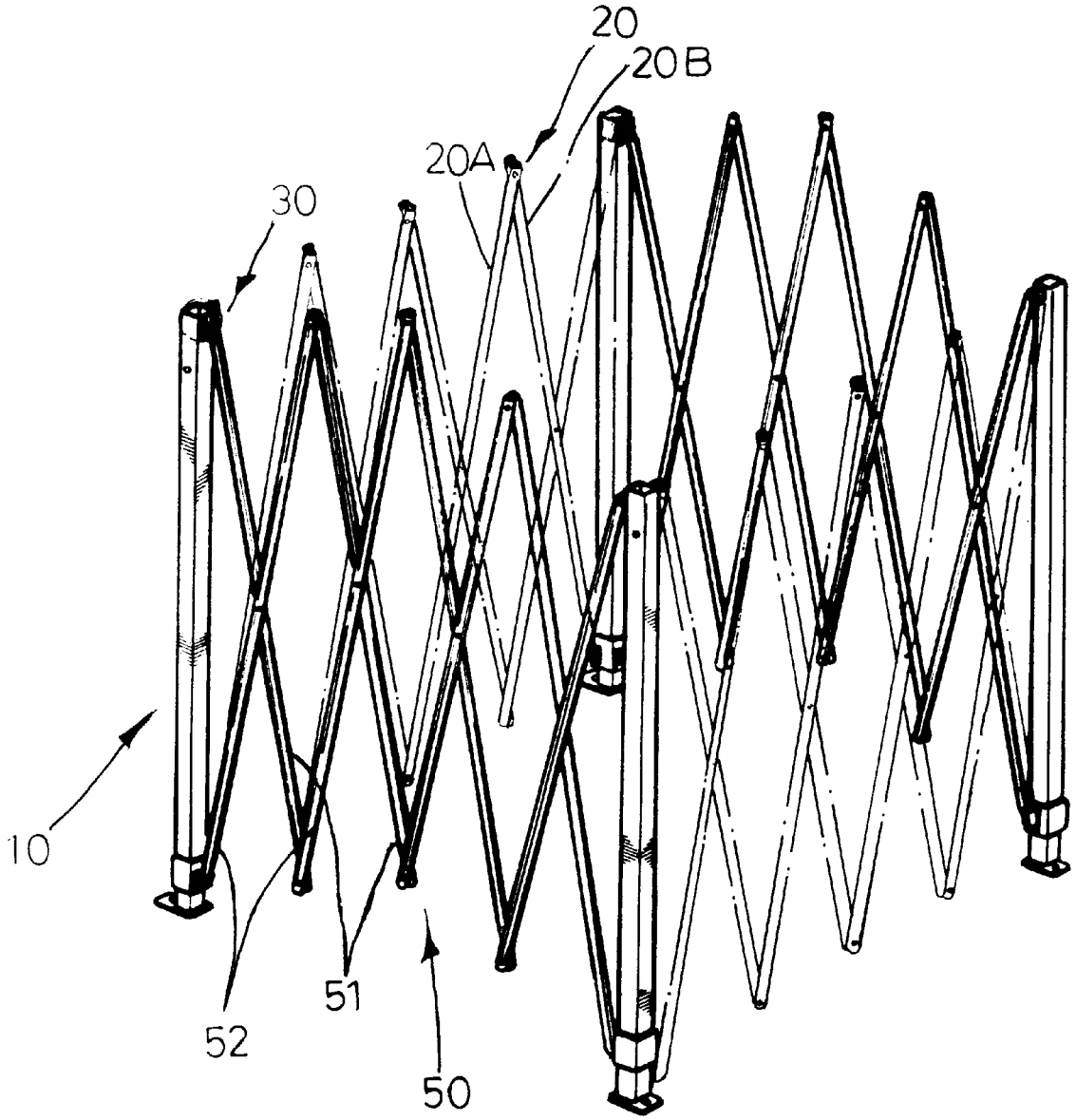
FIG. 3 is a perspective view showing a temporary housing frame according to the present invention.
Figure 4A:
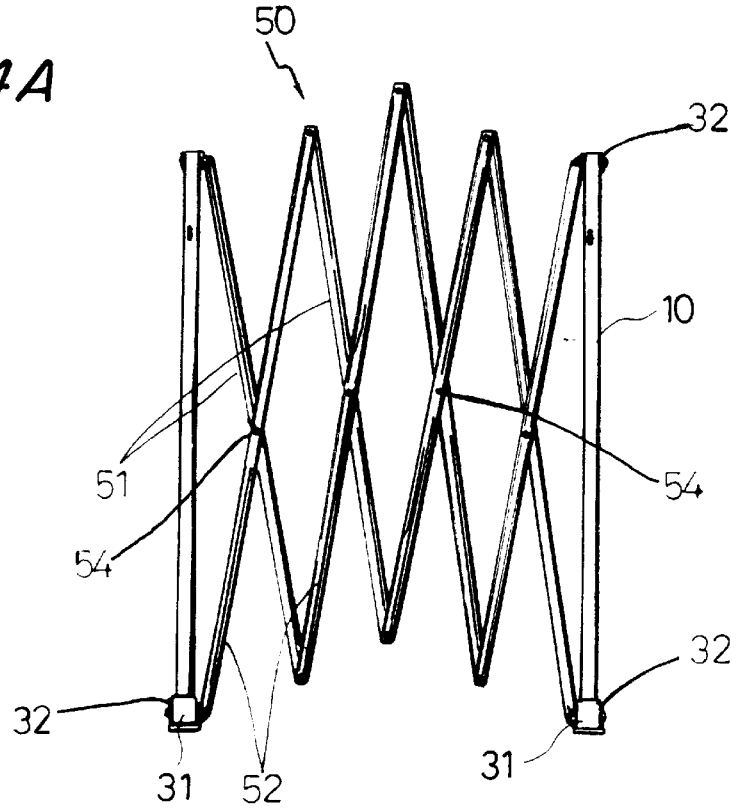
FIG. 4A is a front view showing a second link member in the temporary housing frame of FIG. 3.
Figure 4B:
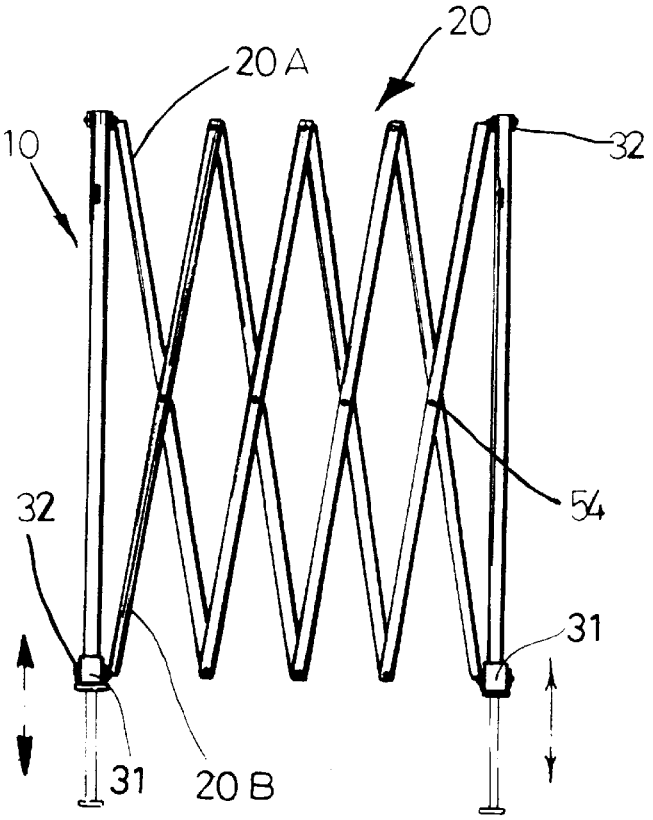
FIG. 4B is a front view showing a first link member in the temporary housing frame of FIG. 3.
Figure 5:
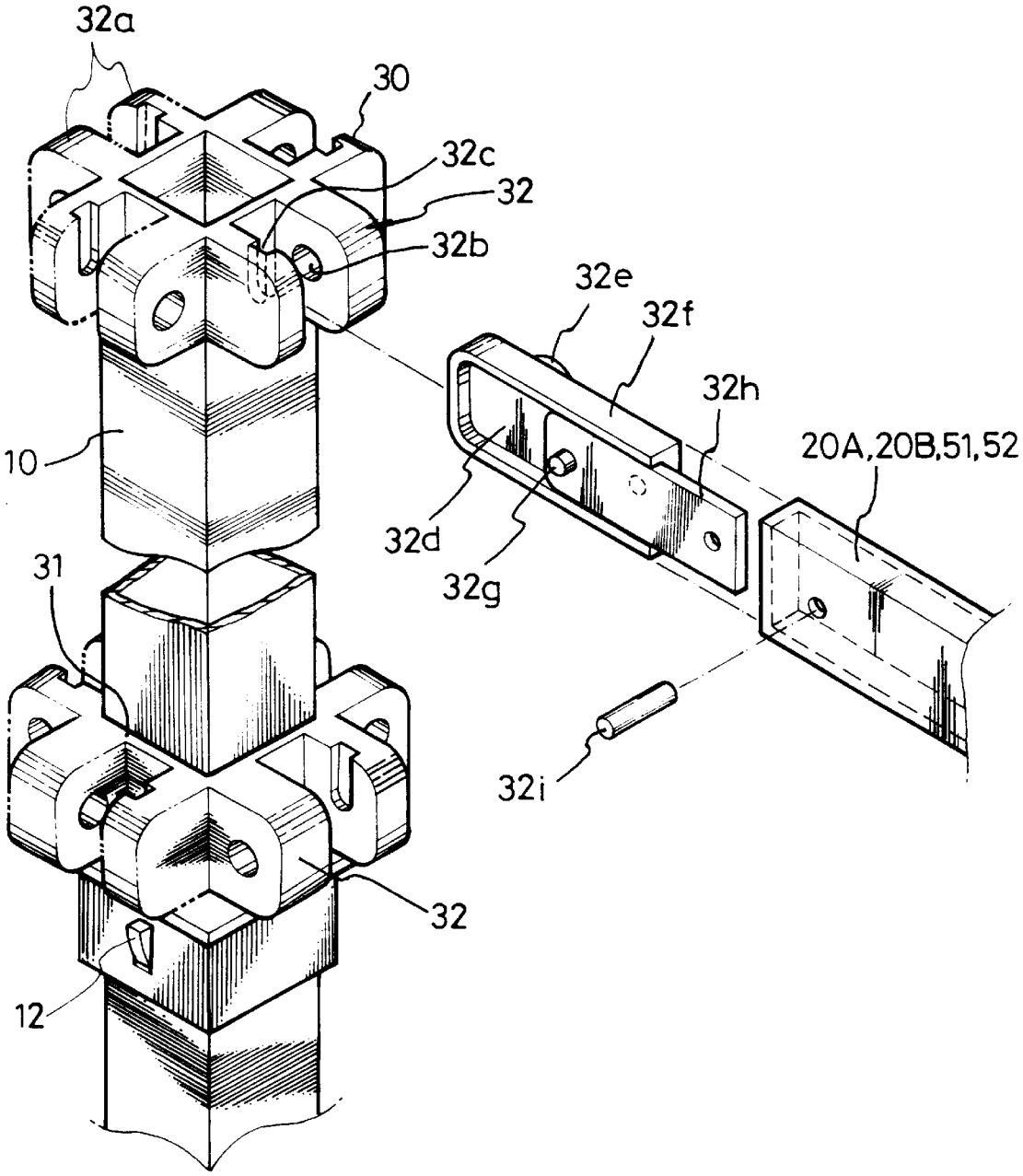
FIG. 5 shows the structure of connection between the first and second link members and a supporting column.
Figure 6A:
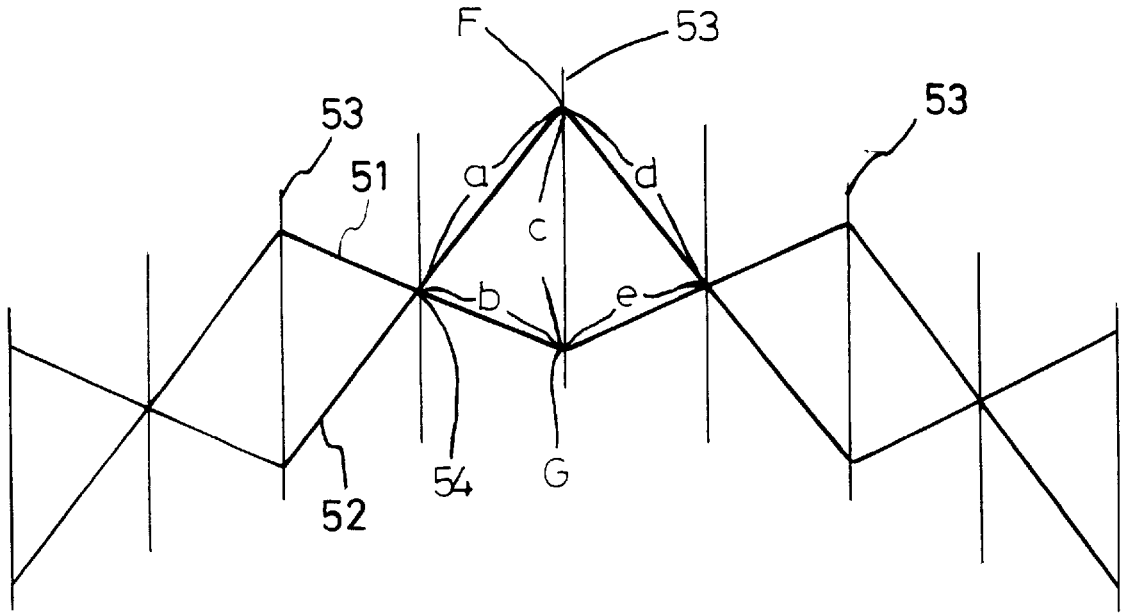
FIG. 6A is an exemplary view for explaining the structure of operation of the second link member in the temporary housing frame according to the present invention.
Figure 6B:
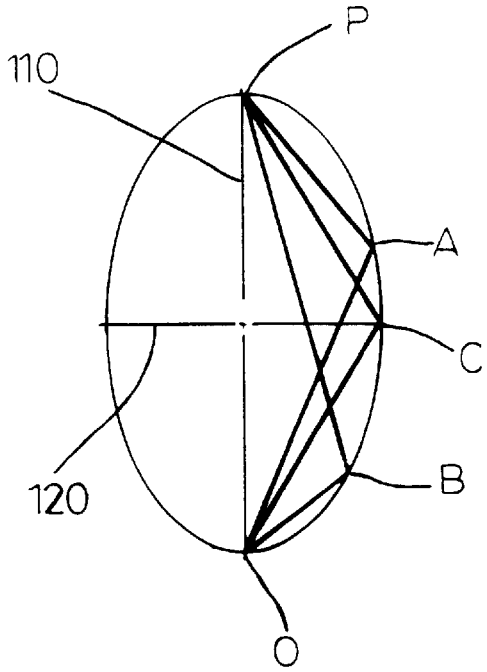
FIG. 6B is an exemplary view for explaining the principle of an ellipse.
Figure 7A:
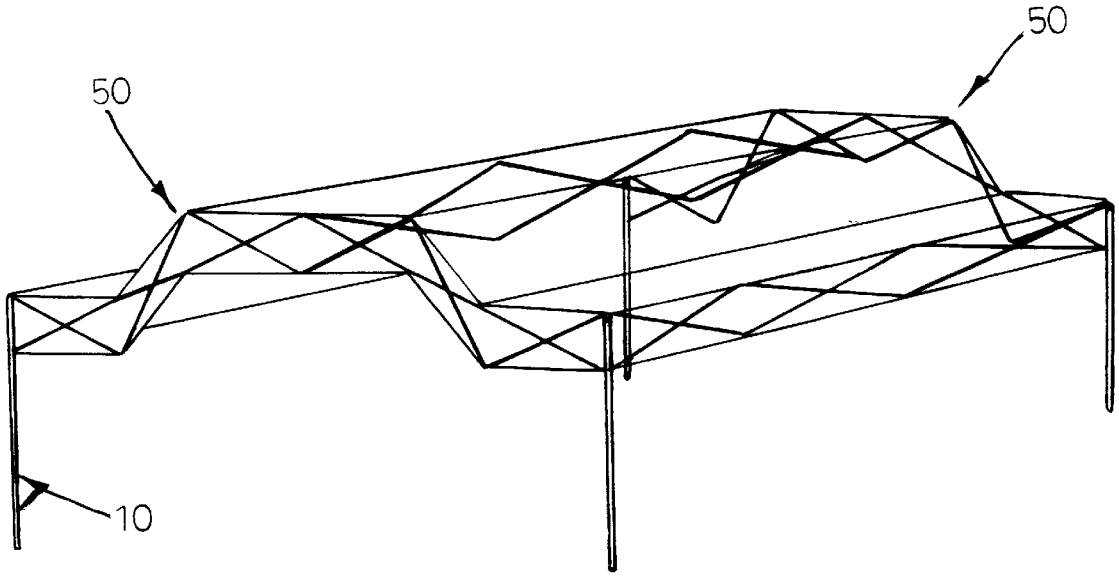
FIGS. 7A through 7D are perspective views showing embodiments of the temporary housing frame according to the present invention.
Figure 7B:
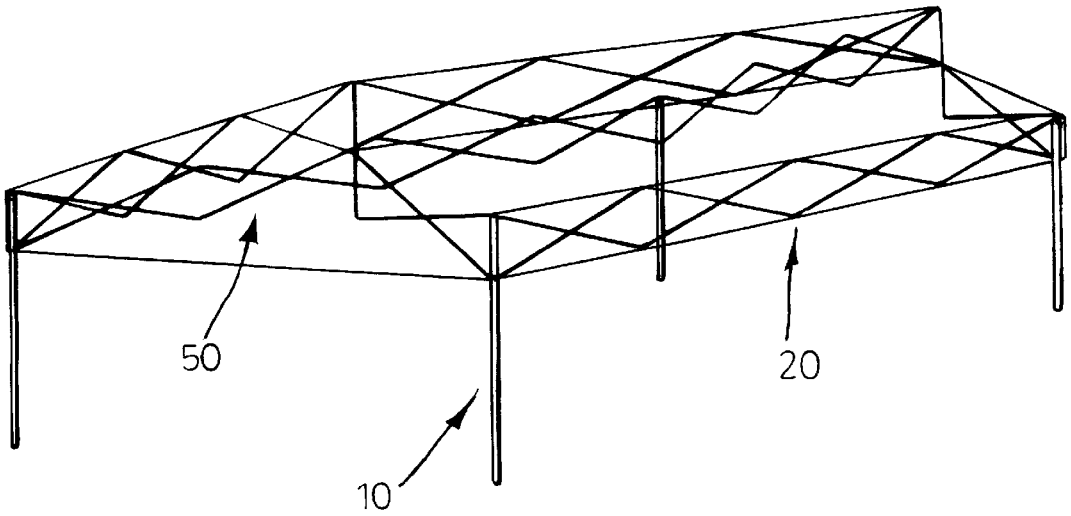
Figure 7C:
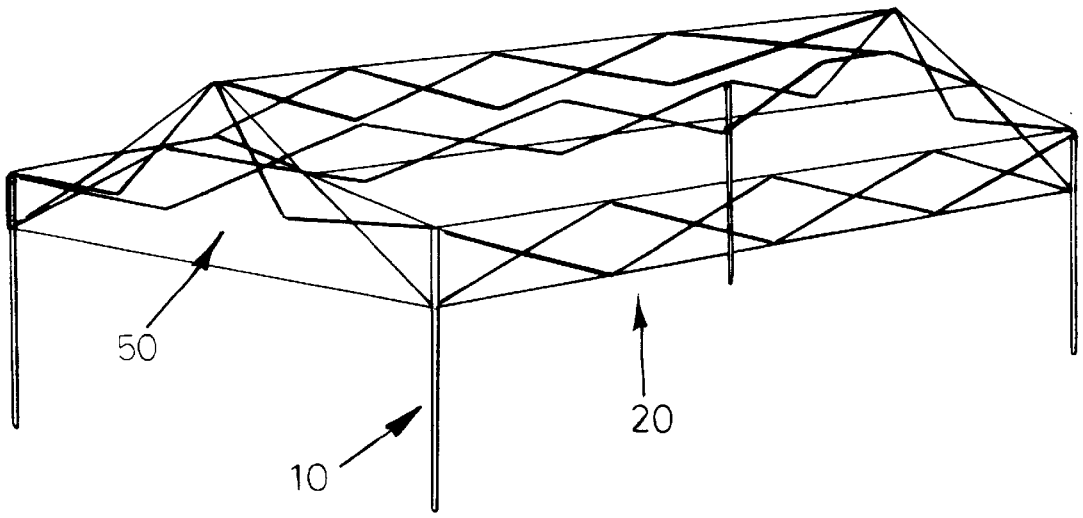
Figure 7D:
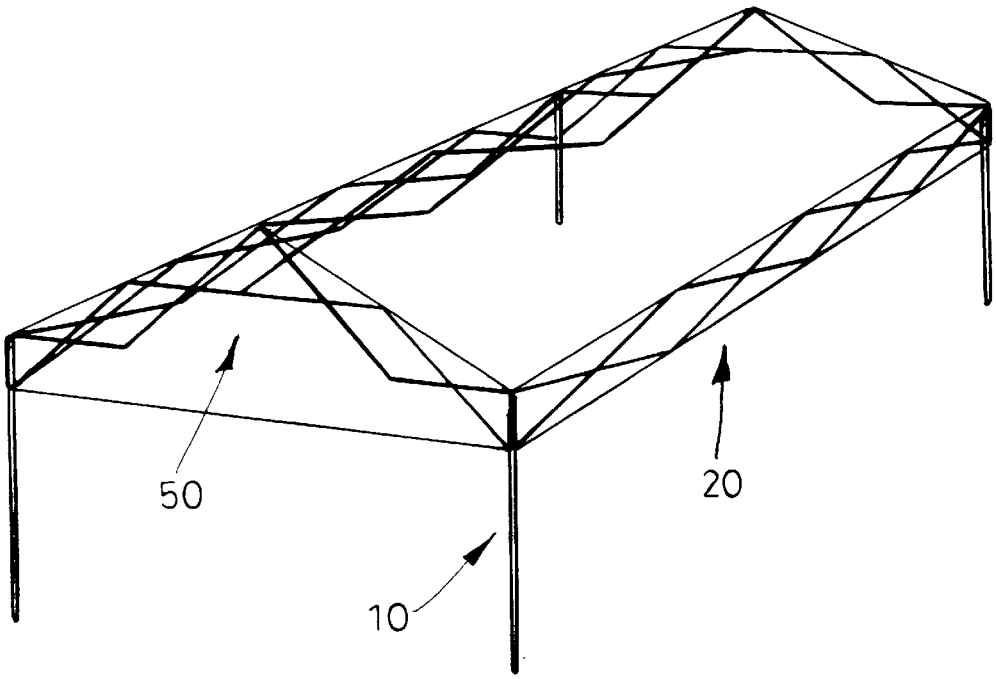

FIG. 3 is a perspective view showing the structure of the present invention. FIGS. 4A and 4B are front views showing second and first link members of FIG. 3, respectively. FIG. 5 shows the structure of connection between the first and second link members and a supporting column. FIGS. 6A and 6B are exemplary views for explaining operation of the second link member and the principle of an ellipse. FIGS. 7A through 7D are perspective views showing embodiments according to the present invention.

Figure 1:
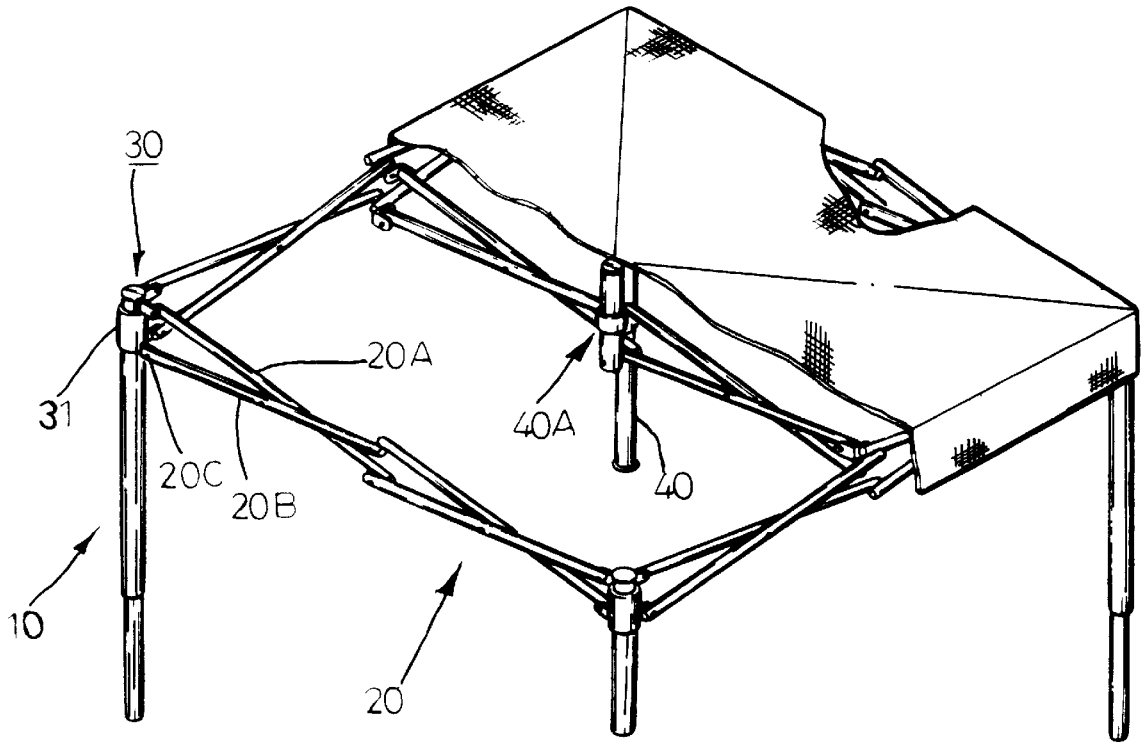
FIG. 1 (Prior Art)
FIG. 1 is a perspective view showing a conventional temporary housing frame.
Figure 2:
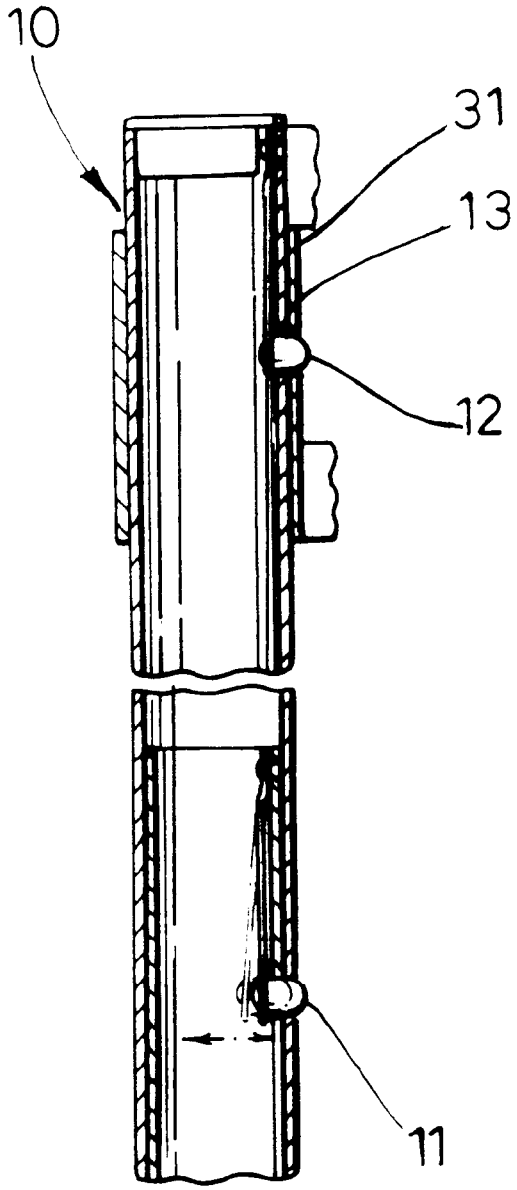
FIG. 2 (Prior Art)
FIG. 2 is a cross-sectional view showing a leg and a slider fixing unit in the conventional temporary housing frame.

As shown in FIGS. 3 through 7D, the temporary housing frame according to the present invention includes a plurality of supporting columns 10 of a predetermined length. The supporting column 10 is formed of a multi-stage rod member, the length of which can telescopically increase or decrease by being pushed into or pulled out by a user. Here, it is preferable that each supporting column includes a leg fixing unit 11 for stopping the rod member from being drawn out by the and pulling from being restored to the original position by its gravitational weight as shown in FIG. 2. However, as the case may be, an integral rod member of a certain length may be used instead of a multi-stage rod member.

The temporary housing frame according to the present invention also includes a first link member 20 which is connected between the two adjacent supporting columns 10 and can be folded or unfolded. Here, it is preferable that rod members 20A and 20B each having the same length are crossed at its center so as to be folded and unfolded laterally, and are sequentially and repeatedly connected to each supporting column 10. Also, the upper portion of both the ends of the first link member 10 is rotatably connected to a fixing piece 32 provided in the upper end of the supporting column 10, and the lower portion thereof is rotatably connected to a slider 31.

The temporary housing frame according to the present invention includes a second link member 50 which connects between the other supporting columns 10 which are not connected by the first link member 20. The second link has members having respectively different lengths crossed and combined rotatably with each other in at least one end, in such a manner that at least one side has an ascending structure if the second link member 50 is unfolded. Here, it is preferable that rod members 51 and 52 each having the different length are crossed at its center so as to be folded and unfolded laterally, and are sequentially and repeatedly connected to each supporting column 10. Also, the upper portion of both ends of the second link member 50 is rotatably connected to a fixing piece 32 provided in the upper end of the supporting column 10, and the lower portion thereof is rotatably connected to a slider 31.

The temporary housing frame according to the present invention also includes a fixing portion 30. The fixing portion 30 includes a slider 31 which is slided up and down on each supporting column 10, for connecting both ends of the first or second link member 20 or 50 to the supporting column 10, and a slider fixing unit provided on each supporting column for stopping the slider from being descendent by its gravitational weight as described above referring to FIG. 2. Here, the fixing portion 30 is provided with a fixing piece 32 formed to connect the first and second link members 20 and 50 on one side of the supporting column 10, which is shown in more detail in FIG. 5.

As can be seen from FIG. 5, the slider 31 is installed on the supporting column 10 so as to be escalated. The fixing piece 32 is attached to the slider 31 and the upper end of the supporting column 10, respectively. The fixing piece 32 connecting the first and second link members 20 and 50 can be installed rotatably in its position. However, it is more preferable that the fixing piece 32 is formed as shown in FIG. 5. As the case may be, the fixing piece 32 is further installed in the supporting column 10 as shown in a two-dot broken line in the drawing. Protrusions 32*a* having a respectively different thickness are formed spaced by a predetermined distance in the upper end of the supporting column 10 or the slider 31. Holes 32*b* and vertical recesses 32*c* of a predetermined depth are formed in the opposing protrusions, respectively. The end of the rod member 20A, 20B, 51 or 52 is connected to the fixing piece 32, through the medium of a first connection member 32*f* having a groove 32*d* and a first pivot 32*e*, a second connection member 32*h* having a second pivot 32*g* and a pin 32*i*. Briefly, the end of the first connection member 32*f* is inserted between the two protrusions 32*a* in the state shown in FIG. 5, and the first pivot 32*e* is inserted into the hole 32*b*. Then, in the state that the second pivot 32*g* is inserted into the vertical groove 32*c* by pivoting the first and second connection members 32*f* and 32*h* upwards, the second connection member 32*h* is forced to be completely combined with the first connection member 32*f*. In this state, the second connection member 32*h* is combined with the rod member 20A, 20B, 51 or 52 by means of a pin 32*i*.

The above-described connection structure may be implemented by other patterns. For example, each rod member 20A, 20B, 51 or 52 may be connected to the supporting column 10 or the slider 31 so as to be pivoted by a predetermined angle.

The second link member 50 which is one of the main features of the present invention is formed of rod members 51 and 52 of a respectively different length which are crossed and pivoted at its center as shown in FIGS. 4A and 6A. In this state, if the rod members 51 and 52 are crossed so that the short rod member 51 is positioned above and the long rod member 52 is positioned below on a vertical line 53 at the starting point of the rod members 51 and 52, the second link member 50 has an ascending structure. Meanwhile, if the rod members 51 and 52 are crossed so that the short rod member 51 is positioned below and the long rod member 52 is positioned above on a vertical line 53 at the starting point of the rod members 51 and 52, the second link member 50 has an descending structure. The second link member 50 is formed in combination of the ascending and descending structures or the former is formed of the ascending structure, in order to embody a temporary housing frame according to the present invention.

FIG. 6A shows an example for combining the relative positions of the short rod member 51 and the long rod member 52 on the vertical line 53. Here, a vertex F formed by connecting the long rod members 52 mutually symmetrically and a vertex G formed by connecting the short rod members 51 mutually symmetrically are positioned above and below on the same vertical line 53, respectively. In this case, the sum of the three sides (a, b and c) of a triangle Δabc is the same as that of the three sides (d, e and c) of another triangle Δdec symmetrical with the triangle Δabc, around the vertical line 53.

The above ascending and descending structures are applications of an elliptical principle which is shown in FIG. 6B. As shown in FIG. 6B, in the case of a point A on the right-hand curved surface of an ellipse where a long axis 110 is positioned on a vertical line, the length between the upper-end vertex P of the long axis 110 and the point A is short, and the length between the lower-end vertex O of the long axis 110 and the point A is long. This means that the point A is positioned above a short axis 120. Meanwhile, in the case of a point B on the curved surface below the short axis 120 of the ellipse, the length between the upper-end vertex P of the long axis 110 and the point B is long, and the length between the lower-end vertex O of the long axis 110 and the point B is short. Meanwhile, in the case of a point C on the short axis 120 of the ellipse, the length between the upper-end vertex P of the long axis 110 and the point C is the same as that between the lower-end vertex O of the long axis 110 and the point C.

Conclusively, when the two rod members of a respectively different length are connected with each other on its center line, a short rod member should be positioned above and a long rod member should be positioned below on the vertical line in order to have an ascending condition. It can be seen that as a short rod member becomes shorter and a long rod member becomes longer, a more ascending effect can be obtained. Here, it is not necessarily to connect the two rod members of a respectively different length at its mutual center. As the case may be, the two rod members can be connected with each other at an off-the-center position.

FIGS. 7A through 7D show various embodiments of the temporary housing frame according to the present invention, which are obtained by combining the first link member 20 where the two rod members of the same length are crossed and connected with each other and the second link member 50 where the two rod members of a respectively different length are crossed and connected with each other, to have an ascending and descending structure.

Figure 8:
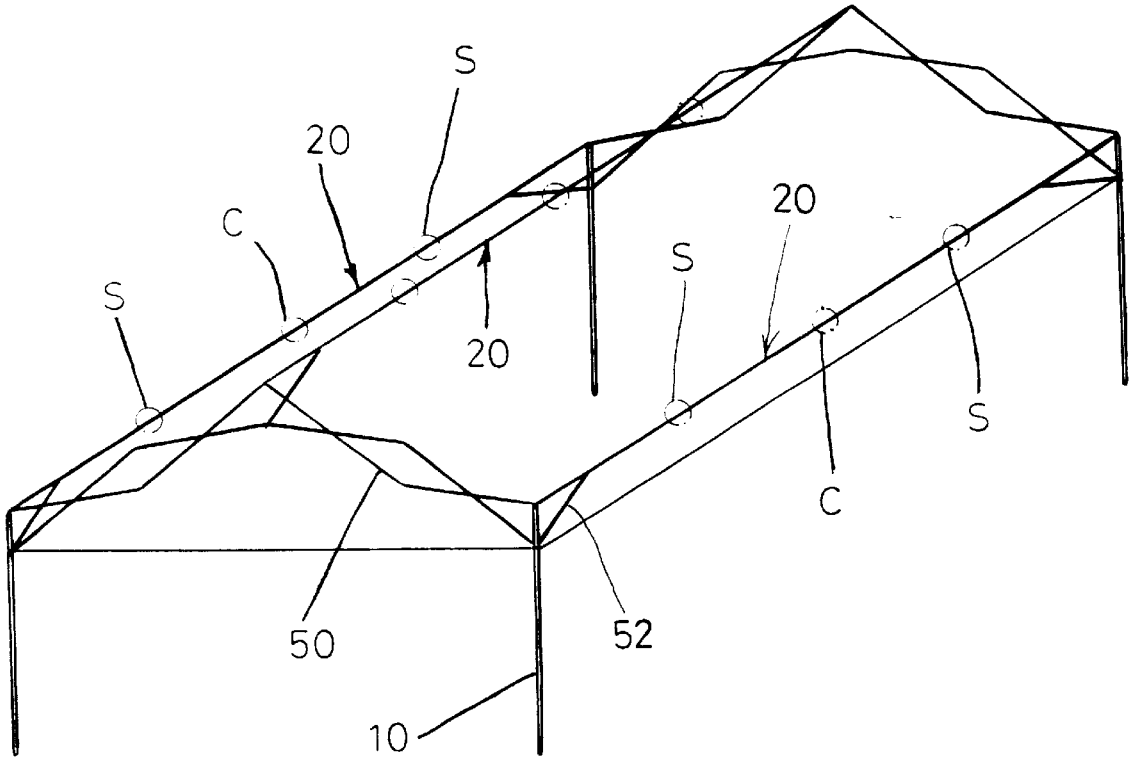
FIG. 8 is a perspective view showing another embodiment of the temporary housing frame according to the present invention.

FIG. 8 is a perspective view showing another embodiment of the temporary housing frame according to the present invention. FIGS. 9A through 9D are front views showing the states of connection between the first link members of FIG. 8. FIG. 10 is a perspective view showing the structure of connection between the first link members of FIG. 8.

In FIG. 8, four supporting columns 10 are formed spaced by a predetermined distance. The two supporting columns 10 disposed in the same side surface are connected with each other by the first link member 20. The first link member 20 can be folded and unfolded as necessary, and is disposed in line when it has been unfolded. The connection state and structure of the first link member 20 will be described later in more detail with reference to FIGS. 9A through 9D and 10.

The two supporting columns 10 of the same side surface which are not connected by the first link member 20 are connected with each other by the second link member 50. The second link member 50 enables a slant roof to be formed, the structure of which is the same as that described above. Thus, the detailed description thereof will be omitted. It is further preferable that the upper ends of the second link members 50 at both sides are connected with each other through the first link member 20.

Figure 9A:
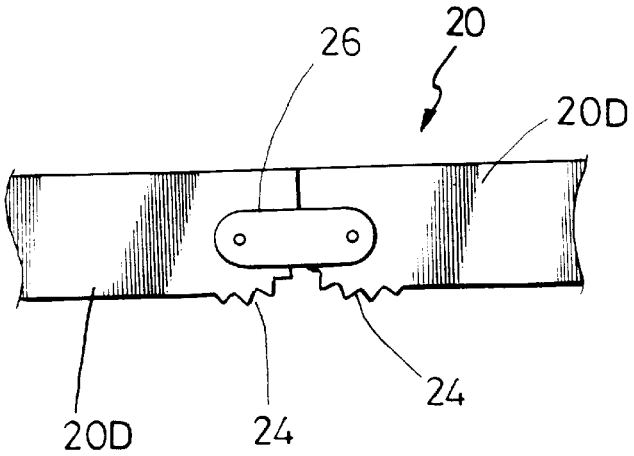
FIGS. 9A through 9D are front views showing the states of connection between the first link members of FIG. 8.
Figure 9B:
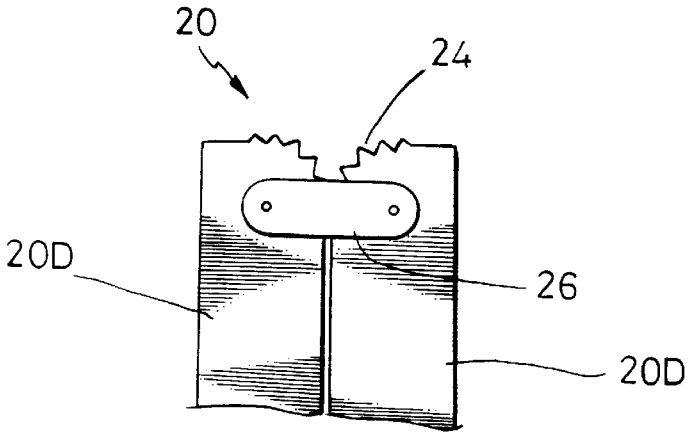
Figure 10:
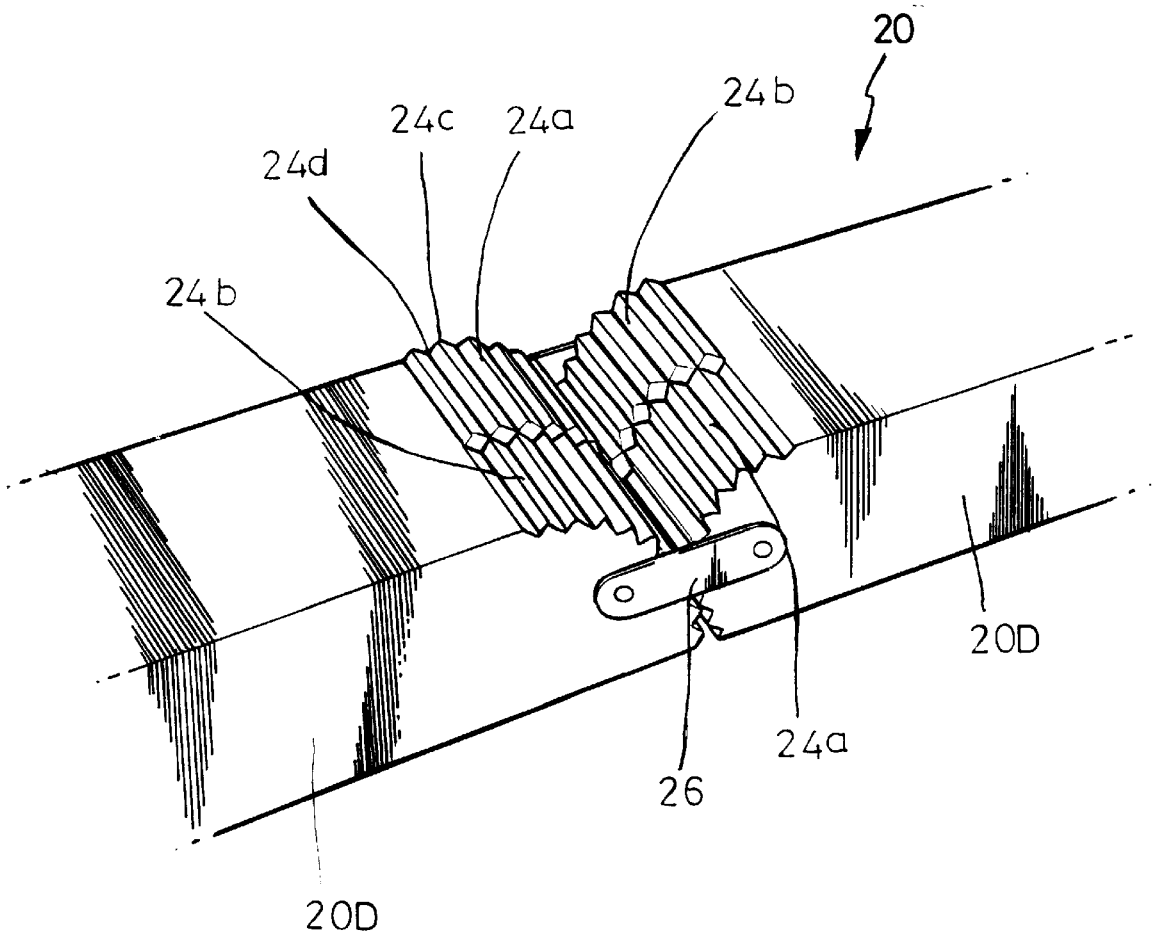
FIG. 10 is a perspective view showing the state of connection between the first link members of FIG. 8.

FIG. 9A shows the connection state at the connection point "s" of both sides in the first link member 20 of FIG. 8. As shown in FIG. 9A, two arm members 20D facing each other are formed of a sawteeth portion 24 which faces below and are connected with each other so as to rotate downwards. The first link member 20 is folded as shown in FIG. 9B if necessary.

Figure 9C:
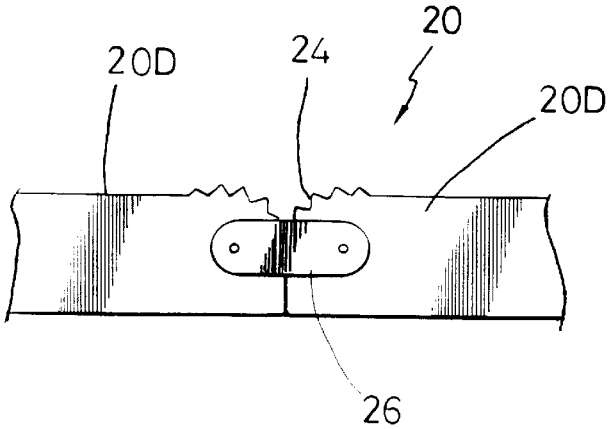
Figure 9D:
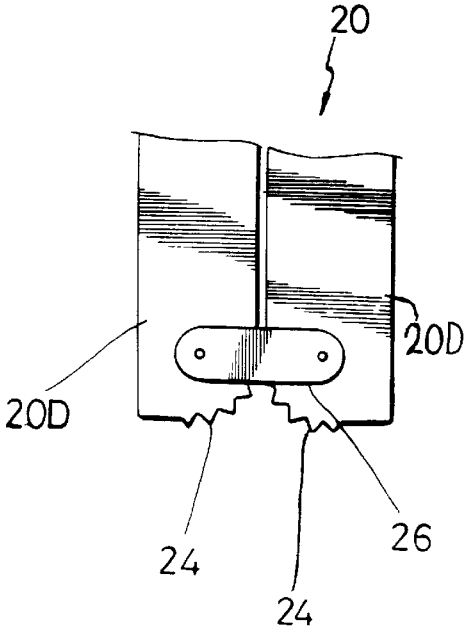

FIG. 9C shows the state of connection at the central connection point "c" of the first link member 20 shown in FIG. 8. As shown in FIG. 9C, the two arm members 20D facing each other are formed of a sawteeth portion 24 which faces above and are connected with each other so as to rotate upwards. The first link member 20 is folded as shown in FIG. 9D if necessary.

FIG. 10 shows the first link member 20. Two arm members 20D are connected with each other through connection members 26, so that they can be folded only in any one direction, that is, upwards or downwards.

As shown in FIG. 10, a first sawteeth 24*a* is formed along one end surface of one arm member 20D and a second sawteeth 24*b* is formed along the other end surface thereof. The second sawteeth 24*b* crisscrosses with the first sawteeth 24*a* in peaks 24*c* and gullies 24*d* of the sawteeth. In the case of the other arm member 20D facing the one arm member 20D, the first sawteeth 24*a* and the second sawteeth 24*b* are also formed adjacent each other. Here, the first sawteeth 24*a* of the one arm member 20D is engaged with the second sawteeth 24*b* of the other arm member 20D, and the second sawteeth 24*b* of the former is engaged with the first sawteeth 24*a* of the latter.

Here, it is crucial that the first and second sawteeth 24*a* and 24*b* are separately formed in the ends of the arm members 20D, respectively, which can allow the number of molds necessary for fabrication of the first link member 20 to be reduced. For example, when the sawteeth are integrally formed in the end of the arm member 20D, the portions engaged with other should be disposed crisscross by the one sawtooth. Accordingly, the shapes of the facing ends differ from each other and thus a separate mold should be needed, which causes more production cost.

Figure 11:
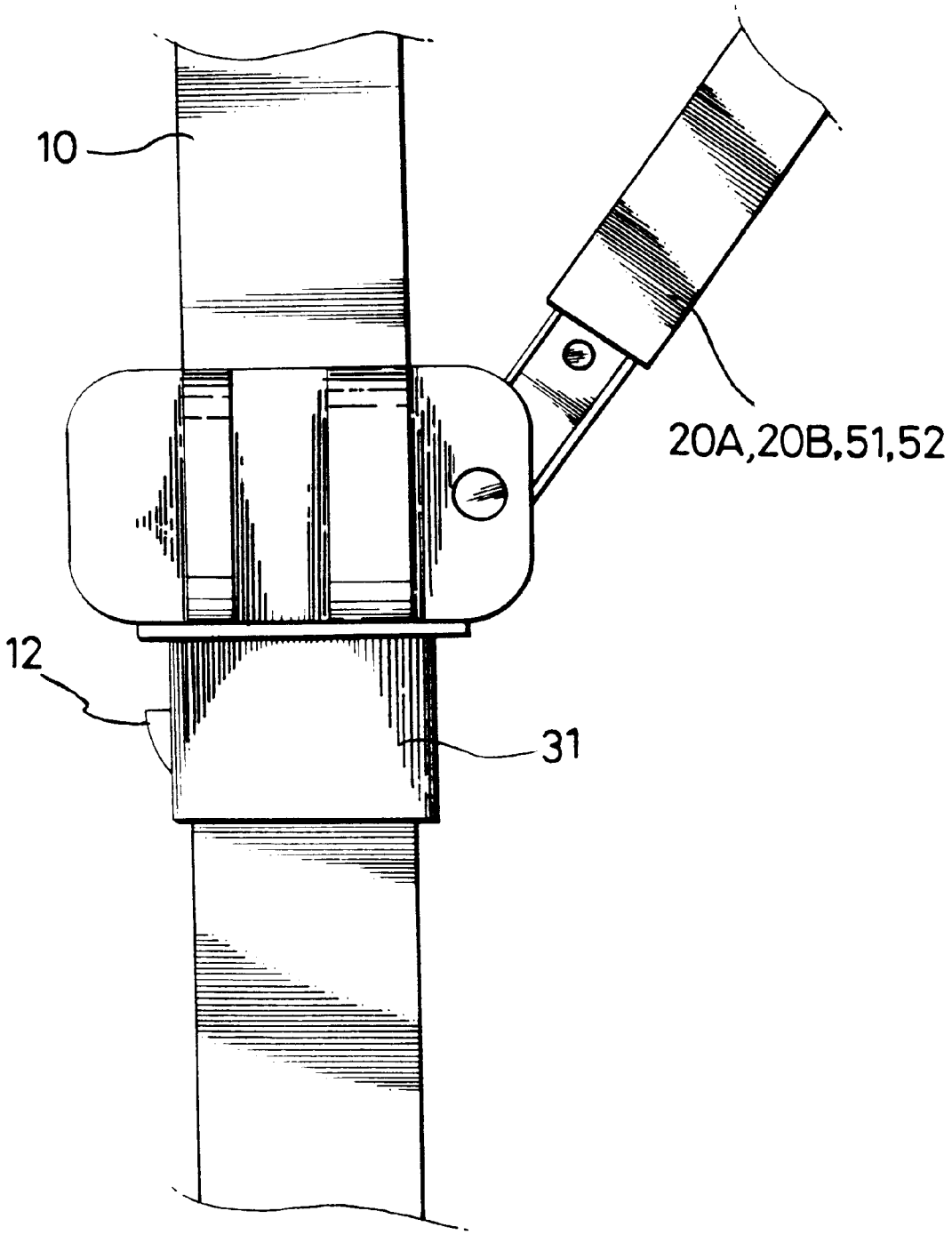
FIG. 11 shows the installation state of a slider fixing unit.

FIG. 11 shows the installation state of a slider fixing unit. In FIG. 11, the slide fixing unit 12 is formed on the supporting column 10 in order to avoid the slider 31 escalating on the supporting column 10 from descending owing to its gravitational weight. The slider fixing unit 12 is formed so that it is curved downwards from the upper end of the supporting column 10. The slider fixing unit 12 is inserted into or drawn out from the supporting column 10 by a user depression or a self-elasticity of an inner elastic body, to thereby stop or release the slider 31.

The present invention provide a temporary housing frame which can form a slope roof having a firm ceiling portion without having a separate central supporting member and a subordinate member. Thus, the spatial use efficiency is excellent and the production cost is reduced by decrease of the working hours in fabrication and assembly. Also, the present invention firmly and persistently maintains the shape of the temporary housing frame such as a tent.

What is claimed is:

1. A temporary housing frame comprising:

a plurality of supporting columns each having a certain length;

a first link member which connects two adjacent supporting columns and can be folded and unfolded, said first link member being formed from equal length rod members crossed at their respective centers;

a second link member which connects between the other supporting columns which are not connected by the first link member and to at least one end of which rod members having a respectively different length are crossed and combined rotatably with each other, in such a manner that at least one side has an ascending structure if the second link is unfolded; and a fixing portion which includes a slider which is slided up and down on each supporting column, for connecting both ends of the first and second link members to the supporting column, a slider fixing unit provided on each supporting column for stopping the slider from being descendent by its gravitational weight, and a fixing piece is attached to said slider and supporting column to connect the first and second link members on one side of the supporting column.

2. A temporary housing frame comprising:

a plurality of supporting columns each having a certain length;

a first link member which connects two adjacent supporting columns and can be folded and unfolded;

a second link member which connects between the other supporting columns which are not connected by the first link member and to at least one end of which rod members having a respectively different length are crossed and combined rotatably with each other, in such a manner that at least one side has an ascending structure if the second link member is unfolded; and a fixing portion which includes a slider which is slided up and down on each supporting column, for connecting both ends of the first and second link members to the supporting column, a slider fixing unit provided on each supporting column for stopping the slider from being descendent by its gravitational weight, and a fixing piece is attached to said slider and supporting column to connect the first and second link members on one side of the supporting column; and wherein said first link member is formed so as to be folded and unfolded laterally, in which rod members each having the same length are crossed at its center, and are sequentially and repeatedly connected to each supporting column, and wherein the upper portion of both the ends of the first link member is rotatably connected to a fixing piece provided in the upper end of the supporting column, and the lower portion thereof is rotatably connected to the slider.

3. A temporary housing frame comprising:

a plurality of supporting columns each having a certain length;

a first link member which connects two adjacent supporting columns and can be folded and unfolded;

a second link member which connects between the other supporting columns which are not connected by the first link member and to at least one end of which rod members having a respectively different length are crossed and combined rotatable with each other, in such a manner that at least one side has an ascending structure if the second link member is unfolded; and a fixing portion which includes a slider which is slided up and down on each supporting column, for connecting both ends of the first and second link members to the supporting column, a slider fixing unit provided on each supporting column for stopping the slider from being descendent by its gravitational weight, and a fixing piece is attached to said slider and supporting column to connect the first and second link members on one side of the supporting column; and wherein said first link member comprises a first sawteeth formed along one end surface at its end and a second sawteeth formed along the other end surface thereof of which peaks and gullies crisscross with those of the first sawteeth.

4. The temporary housing frame according to claim 1, wherein said second link member is formed so as to be folded and unfolded laterally, in which rod members each having a respectively different length are crossed at its center, and are sequentially and repeatedly connected to each supporting column, and wherein the upper portion of both the ends of the second link member is rotatably connected to a fixing piece provided in the upper end of the supporting column, and the lower portion thereof is rotatably connected to the slider.

5. The temporary housing frame according to claim 2, wherein said second link member is formed so as to be folded and unfolded laterally, in which rod members each having a respectively different length are crossed at its center, and are sequentially and repeatedly connected to each supporting column, and wherein the upper portion of both the ends of the second link member is rotatably connected to a fixing piece provided in the upper end of the supporting column, and the lower portion thereof is rotatably connected to the slider.

6. The temporary housing frame according to claim 3, wherein said second link member is formed so as to be folded and unfolded laterally, in which rod members each having a respectively different length are crossed at its center, and are sequentially and repeatedly connected to each supporting column, and wherein the upper portion of both the ends of the second link member is rotatably connected to a fixing piece provided in the upper end of the supporting column, and the lower portion thereof is rotatably connected to the slider.

* * * * *